US007621082B2

(12) United States Patent
Morton

(10) Patent No.: US 7,621,082 B2
(45) Date of Patent: Nov. 24, 2009

(54) WINDOW ASSEMBLY HAVING AN OUTER SASH FRAME SUPPORTING A REMOVABLE INNER SUB-SASH FRAME BONDED TO INSULATED GLASS PANELS

(75) Inventor: Philip G. Morton, Germantown, OH (US)

(73) Assignee: Deceuninck North America, LLC, Monroe, OH (US)

( * ) Notice: Subject to any disclaimer, the term of this patent is extended or adjusted under 35 U.S.C. 154(b) by 995 days.

(21) Appl. No.: 10/792,113

(22) Filed: Mar. 3, 2004

(65) Prior Publication Data

US 2005/0210815 A1 Sep. 29, 2005

(51) Int. Cl.
*E06B 3/30* (2006.01)
*E06B 3/964* (2006.01)
*E04C 2/38* (2006.01)
*E04C 2/54* (2006.01)

(52) U.S. Cl. ..... 52/204.54; 52/786.13; 52/204.62; 52/656.5

(58) Field of Classification Search ..... 52/204.54, 52/204.53, 204.56, 212, 204.1, 204.5, 204.593, 52/204.591, 204.597, 204.7, 204.62, 204.64, 52/656.5, 786.1, 786.13; 49/504
See application file for complete search history.

(56) References Cited

U.S. PATENT DOCUMENTS 2,945,269 A * 7/1960 Domen ..... 52/127.6
2,993,242 A * 7/1961 Leisibach ..... 52/204.593
3,393,486 A * 7/1968 Pasche ..... 52/204.593
4,018,022 A * 4/1977 Fink ..... 52/204.593
4,187,657 A * 2/1980 Sukolics ..... 52/204.591
4,372,094 A * 2/1983 Boschetti ..... 52/745.13
4,753,056 A * 6/1988 Pacca ..... 52/204.593
5,003,747 A 4/1991 Morton
5,260,112 A * 11/1993 Grether et al. ..... 428/34
5,687,518 A * 11/1997 Endo et al. ..... 52/204.1
5,692,349 A * 12/1997 Guillemet ..... 52/204.53
6,205,723 B1 * 3/2001 Farrar et al. ..... 52/202
6,263,626 B1 * 7/2001 Gerhardt ..... 52/204.5
6,286,288 B1 9/2001 France
6,318,036 B1 11/2001 Siudzinski et al.
6,327,826 B1 * 12/2001 Mann ..... 52/204.1
6,536,182 B2 3/2003 France
6,675,537 B2 1/2004 Morton et al.

(Continued)

FOREIGN PATENT DOCUMENTS

GB 2191809 A * 12/1987

*Primary Examiner*—Richard E Chilcot, Jr.
*Assistant Examiner*—Ryan D Kwiecinski
(74) *Attorney, Agent, or Firm*—Jacox, Meckstroth & Jenkins

(57) ABSTRACT

A rectangular outer sash frame has extruded plastic frame members with inwardly projecting flange portions overlapping a peripheral edge portion of an outer glass panel of an insulated glass unit. A removable inner sub-sash frame interconnects with the outer sash frame and has extruded plastic frame members with inwardly projecting flange portions overlapping and bonded to a peripheral edge portion of at least one of the glass panels. Extruded plastic glazing members have flange portions overlapping a peripheral edge portion of the inner glass panel and include retaining flange portions projecting between the outer sash frame and the inner sub-sash frame. In another embodiment, the sub-sash frame has integrally extruded parallel spaced walls projecting inwardly between and bonded to the peripheral edge portions of both the inner and outer glass panels.

12 Claims, 2 Drawing Sheets

U.S. PATENT DOCUMENTS 6,848,225 B2 * 2/2005 Lapierre ..... 52/204.53
6,889,480 B2 * 5/2005 Guhl et al. ..... 52/786.1
6,974,518 B2 * 12/2005 Hornung et al. ..... 156/109
2002/0059758 A1 * 5/2002 Dodson et al. ..... 52/204.1
2002/0189743 A1 * 12/2002 Hornung et al. ..... 156/109
2003/0070371 A1 * 4/2003 Kobrehel ..... 52/204.5
2005/0081981 A1 * 4/2005 Heikkila ..... 156/109

* cited by examiner

WINDOW ASSEMBLY HAVING AN OUTER SASH FRAME SUPPORTING A REMOVABLE INNER SUB-SASH FRAME BONDED TO INSULATED GLASS PANELS

BACKGROUND OF THE INVENTION

In the construction of window and door assemblies, it is common to use insulated glass panel units of the general type disclosed in U.S. Pat. Nos. 5,003,747 and 6,675,537 which issued to or are owned by the assignee of the present invention. Usually, the insulated glass units include two parallel spaced rectangular glass panels having peripheral edge portions which receive a rectangular spacer frame. The edge portions and spacer frame are bonded and sealed together by a bonding compound such as a butyl rubber compound or a similar bonding material surrounding the spacer frame. The insulated glass panel unit is assembled into a surrounding rectangular sash frame and is retained by glazing members or beads. Preferably the sash frame and glazing beads are formed from extrusions of plastics material such as polyvinyl chloride (PVC). Such insulated glass panel units are commonly used in fixed window assemblies such as picture windows, single hung windows, sliding windows, bow and bay windows and sliding and swinging patio door assemblies such as disclosed, for example, in U.S. Pat. No. 6,318,036 which issued to the assignee of the present invention.

In insulated glass panel units as described above, it is common for the outer edges of the glass panels to be exposed and unprotected during handling and shipping or be covered by a thin layer of the bonding and sealing compound. When the outer edges of the glass panels are relatively unprotected, insulated glass panel units must be carefully handled and carefully protected during shipping. Also, when the edge surfaces of the glass panels are exposed, the personnel handling the insulated glass panel units need to wear gloves in order to avoid cutting their fingers or receiving glass splinters. It is also desirable for a fixed window assembly, such as a picture window assembly, to provide for conveniently removing the insulated glass panel unit in the event of glass breakage or damage or moisture seeps into the space between the glass panels and results in etching the inner surfaces of the glass panels.

SUMMARY OF THE INVENTION

The present invention is directed to an improved window assembly having insulated glass panels and which is ideally suited for use in a fixed glass window unit such as a picture window, a single hung window and sliding and swinging patio doors assemblies. The window assembly of the invention provides for conveniently handling and shipping an insulated glass panel unit while protecting the unit and also provides for conveniently removing the insulated glass panel unit from the surrounding sash frame and from the inside of the window assembly in the event the unit requires repair or replacement. In addition, when the insulated glass panel unit is inserted into the surrounding sash frame, the unit locks to the sash frame so that it is precisely located and is prevented from shifting laterally relative to the sash frame without the use of spacers.

In accordance with one embodiment of the invention, a window assembly constructed in accordance with the invention includes a rectangular outer sash frame formed of sash frame members of extruded rigid plastics material and rigidly connected at the corners of the frame, for example, by miter cuts and welding. The outer sash frame includes a laterally inwardly projecting flange which engages and seals with the outer glass panel of the insulated glass panel unit. A rectangular inner sub-sash frame is formed with sub-sash frame members of extruded rigid plastics material and are also rigidly connected at the corners of the frame such as by miter cuts and welding. The sub-sash frame also includes a laterally inwardly projecting flange which overlaps a peripheral edge portion of one of the glass panels, and the flange is bonded to the glass panel. The sub-sash frame interlocks with the outer sash frame when assembled for precisely locating the sub-sash frame within the surrounding outer sash frame and to limit relative lateral movement. Extruded plastic glazing members have laterally inwardly projecting flange portions which overlap and seal with a peripheral edge portion of the inner glass panel. The glazing members engage a shoulder on an inner wall of the outer sash frame and have spring flange portions which project outwardly between the inner wall and the sub-sash frame and press against the sub-sash frame.

Other features and advantages of the invention will be apparent from the following description, the accompanying drawings and the appended claims.

DESCRIPTION OF THE PREFERRED EMBODIMENTS

Figure 1:
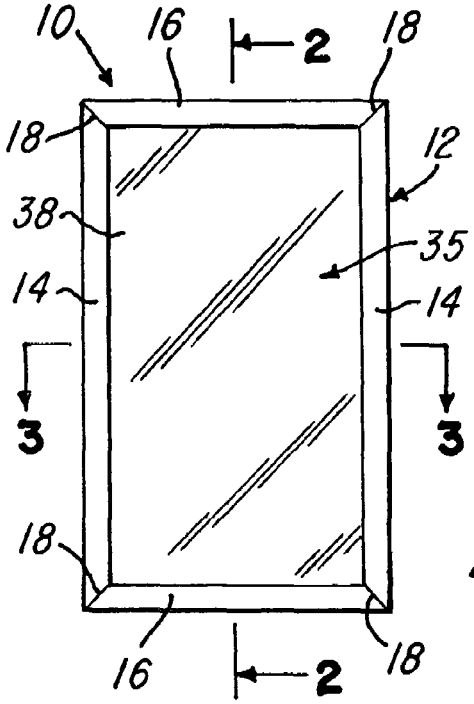
FIG. 1 is an elevational view of a fixed window assembly constructed in accordance with the invention.

FIG. 1 illustrates a window assembly 10 which includes a rectangular outer sash frame 12 formed by elongated sash frame sections or members 14 and 16 which are extruded of a rigid plastics material such as rigid polyvinyl chloride (PVC). The sash frame members 14 and 16 are rigidly connected at the corners of the frame 12 by mitered cuts and welded corner joints 18. As used herein, the term rectangular with respect to the shape of the frame 12 also includes a square frame. Also, instead of the mitered cuts and welded corner joints 18, the frame sections or members 14 and 16 may be rigidly connected by mechanical fasteners such as screws.

Figure 2:
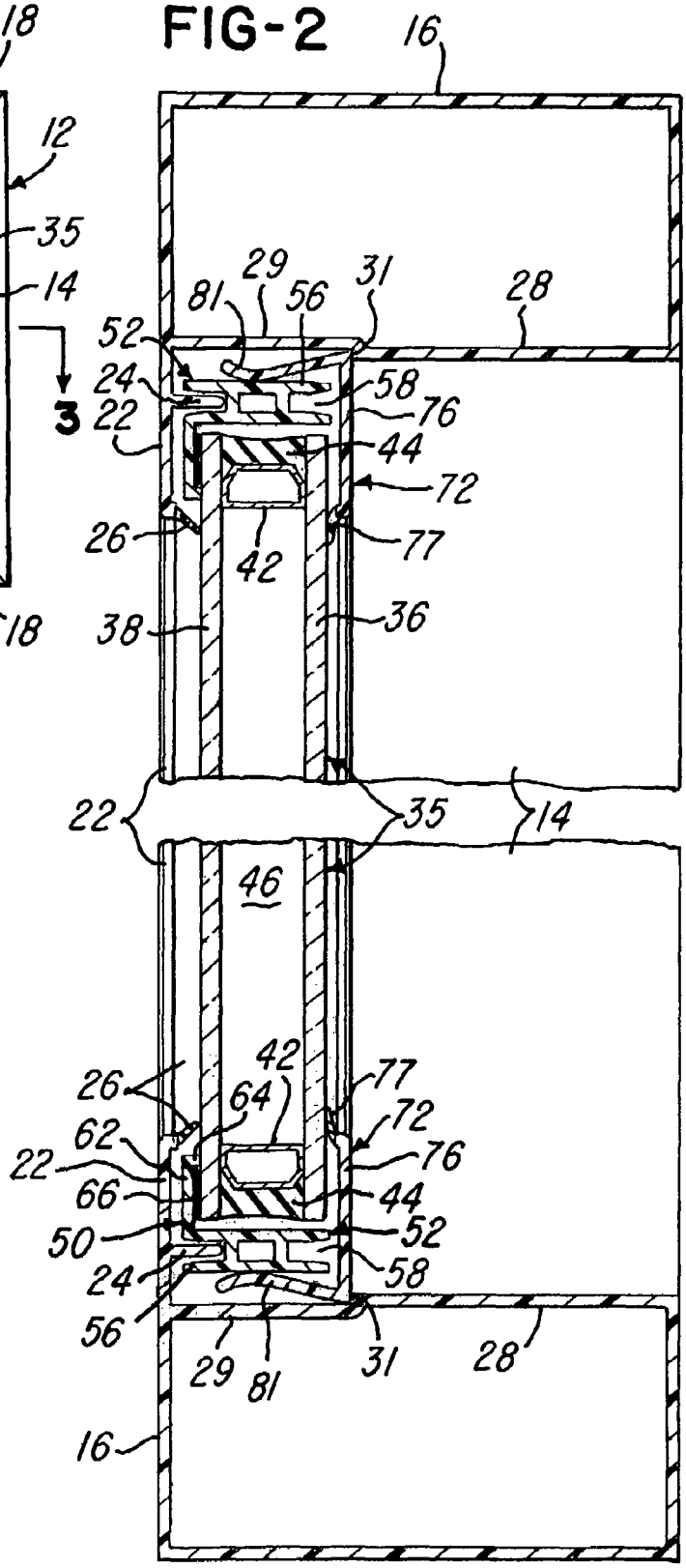
FIG. 2 is an enlarged vertical section taken generally on the line 2-2 of FIG. 1 and with a center portion broken away.
Figure 3:
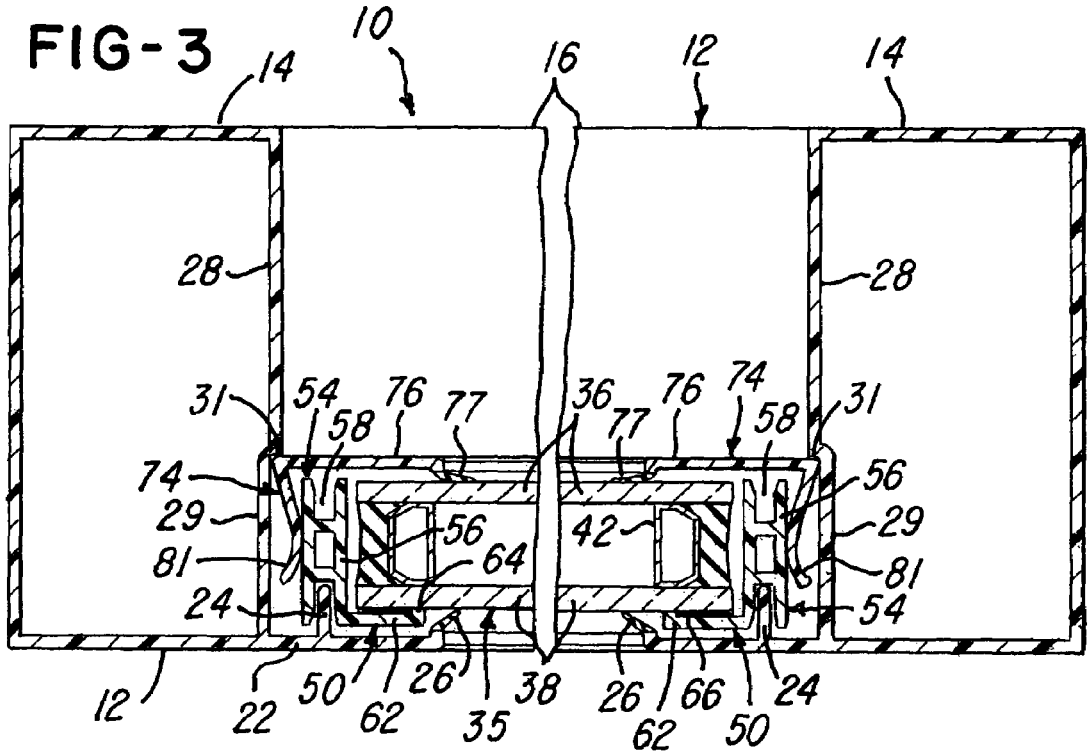
FIG. 3 is an enlarge horizontal section taken generally on the line 3-3 of FIG. 1 and with a center portion broken away.

Referring to FIGS. 2 and 3, each of the frame sections or members 14 and 16 are shown with the same cross-sectional configuration, and the outer tubular portion of each sash frame member is shown as substantially rectangular in cross-section. However, it is to be understood that the outer portion of each sash frame section or member may have any desired cross-sectional configuration. As also shown in FIGS. 2 and 3, each of the sash frame members 14 and 16 includes a laterally inwardly projecting flange portion 22 having an inwardly projecting longitudinally extending rib 24 and an inwardly projecting flexible lip seal 26. As generally known in the industry, the flexible lip seals 26 are co-extruded of a PVC material having a lower durometer so that the lip seals are somewhat flexible when compared with the substantially rigid PVC material forming the sash members 14 and 16. Each of the sash frame members 14 and 16 also has an inner wall 28 with an offset or step portion 29 forming a longitudinally extending shoulder 31.

An insulated glass panel unit 35 includes a rectangular inner glass panel 36 and a parallel spaced rectangular outer glass panel 38. In a conventional manner, the glass panels 36 and 38 are spaced parallel by an internal rectangular spacer frame 42 which is commonly formed from a roll formed aluminum sheet metal strip, but may also be formed from another form of spacer material. A bonding compound or material 44, such as a compound of butyl rubber, surrounds the spacerframe 42 and bonds to the peripheral inner surfaces of the glass panels 36 and 38 to form a sealed air-tight space 46 between the glass panels. The space 46 may be filled with a suitable gas such as argon, and the spacer frame 42 may be used to enclose a desiccant material to absorb any moisture within the space 46.

In accordance with the present invention, a rectangular inner sub-sash frame 50 is enclosed within the outer sash frame 12 and is formed by elongated sub-sash frame members 52 (FIG. 2) and 54 (FIG. 3) which are rigidly connected at the corners of the sub-sash frame, for example, by mitered cuts and welding or by mechanical fasteners such as screws. Each of the sub-sash frame members 52 and 54 are also extruded of a substantially rigid plastics material, such as rigid PVC, and have an outer base portion 56 with inwardly and outwardly facing slots 58 forming generally an H-shaped cross-sectional configuration. Each of the sub-sash frame members 52 and 54 also includes an integrally extruded flange portion 62 which projects laterally inwardly into overlapping relation with a peripheral edge portion of the outer glass panel 38.

The flange portion 62 has an inwardly projecting inner lip 64 which contacts the outer surface of the outer glass panel 38, and a bonding compound or material 66, such as a butyl rubber compound, positively bonds the flange portion 62 to the outer peripheral portion of the glass panel 38. As shown in FIGS. 2 and 3, the base portion 56 of the sub-sash frame members 52 and 54 closely surround the glass panel unit 35 and has substantially the same width in order to cover and protect the outer edges of the glass panels 36 and 38.

In the assembly of the window, the sub-sash frame 50 is placed on a table, and the bonding material 66 is placed on the flange portion 62. The glass panel unit 35 is then lowered into the sub-sash frame 50 until the frame 50 is bonded and sealed to the outer glass panel 38 of the insulated glass panel unit 35. The sub-sash frame 50 and attached glass panel unit 35 are then assembled into the outer sash frame 12 by laying the outer sash frame 12 on the table and then lowering the sub-sash frame 50 and glass panel unit 35 downwardly until the peripherally extending ribs 24 of the outer sash frame flanges 22 are received within the mating grooves 58 of the sub-sash frame members 52 and 54, as shown in FIG. 3. During this assembly, the flexible lip seals 26 engage the outer surface of the outer glass panel 38 and form a fluid-tight seal between the outer sash frame 12 and the glass panel unit 35.

The sub-sash frame 50 and the attached insulated glass unit 35 are retained and secured within the outer sash frame 12 by a set of glazing sections or members 72 and 74 which are formed from an extrusion of rigid plastics material such as PVC . The glazing members 72 and 74 are not connected but have mitered or abutting corner joints on the inside of the window assembly 10. Each of the glazing members 72 and 74 includes a flange portion 76 which projects laterally inwardly in overlapping relation with a peripheral edge portion of the inner glass panel 36 and has an integrally extruded flexible sealing lip 77 which is formed like the sealing lip 26 and engages the inner surface of the inner glass panel 36 to form a fluid-tight seal. Each of the glazing members 72 and 74 also includes an outer slightly curved flange portion 81 which is integrally extruded with the inner flange portion 76 and projects outwardly to engage the outer surface of the corresponding sub-sash frame member 52 or 54. The flange portion 81 is slightly flexible and spring-like so that a corner portion of the glazing member is forced laterally outwardly into engagement with the shoulder 31 on the inner wall 28 of the corresponding outer sash frame member 14 or 16. The glazing members 72 and 74 thereby lock the sub-assembly of the sub-sash frame 50 and glass panel unit 35 onto the outer sash frame, as shown in FIGS. 2 and 3.

Figure 4:
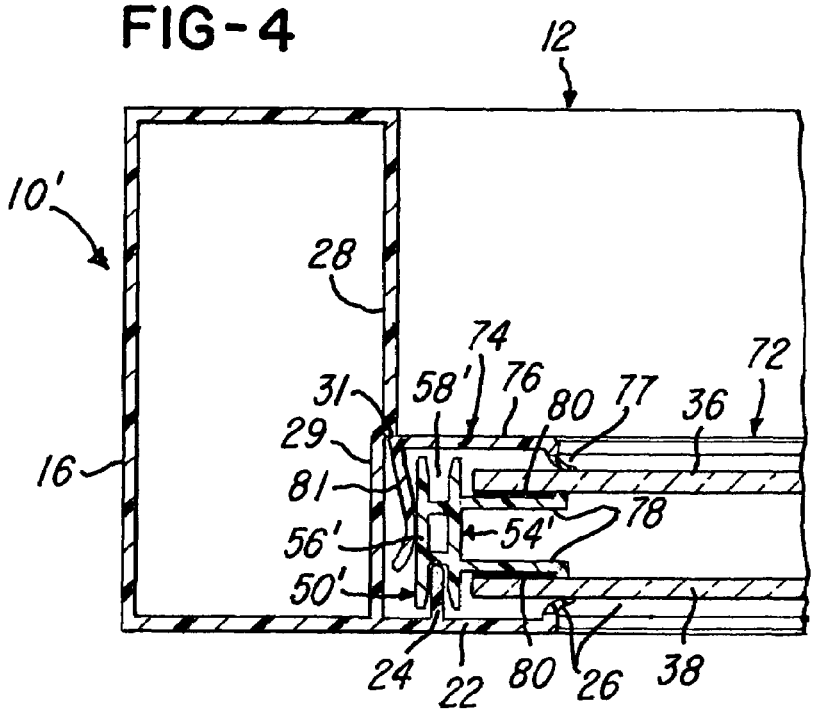
FIG. 4 is a fragmentary section similar to FIG. 3 and showing a modification of a window assembly constructed in accordance with the invention.

Referring to FIG. 4 which shows another embodiment of the invention, a window assembly 10' includes and outer sash frame 12 and glazing member 72 and 74 as described above in connection with FIGS. 1-3. In this embodiment, however, a sub-sash frame 50' includes sub-sash frame members 54' and 52' (not shown) which are formed from an extrusion of rigid plastics or PVC material and have base portion 56' with slots 58'. Each of the sub-sash frame members also includes integrally extruded and parallel spaced flanges or wall portions 78 which project laterally inwardly between the glass panels 36 and 38 and are bonded to peripheral edge portions of the glass panels by a suitable bonding material 80 such as a butyl rubber compound. With respect to the construction and attachment of the flanges or wall portions 78 to the inner surfaces of the glass panels 36 and 38, The disclosures of U.S. Pat. Nos. 6,286,288 and 6,536,182, which are owned by SashLite, LLC, are herein incorporated by reference.

From the drawings and the above description, it is apparent that a window assembly constructed in accordance with the present invention, provides desirable features and advantages. For example, after the sash frame 12, sub-sash frame 50 and glass panel unit 35 are assembled, as shown in FIGS. 2 and 3, moisture from the outside is prevented from seeping into the space 46 between the glass panels 36 and 38 by not only the lip seal 26 and bonding compound 66, but also the bonding compound 44 surrounding the spacer frame 42. It is also apparent that when the sub-sash frame 50 is attached to the glass panel unit 35, the frame 50 provides for not only protecting the outer edge portions of the glass panels 36 and 38, but also for conveniently handling and transporting the glass panel unit 35 after it is assembled and until it is lowered into the outer sash frame 12.

The assembly of the sub-sash frame 50 and attached glass panel unit 35 may also be conveniently removed from inside the building after the outer sash frame 12 has been installed simply by using a sharp blade and prying laterally inwardly on the glazing members 72 and 74 against the bias of the spring flanges 81 until the glazing members are released from the shoulders 31 on the outer sash frame 12. Such convenient removal of the glass panel unit 35 with the sub-sash frame 50 is occasionally desirable from inside the building, for example, when a glass panel 36 or 38 has been damaged or broken. It is also apparent from FIGS. 2 and 3 that the interfitting connection of the outer sash frame 12 and the sub-sash frame 50, by means of the peripherally extending rib 24 within one of the peripherally extending grooves 58, effectively eliminates or limits any lateral movement of the sub-sash frame 50 and glass panel unit 35 relative to the outer sash frame 12. The modification shown in FIG. 4 also provides all of the above advantages in addition to eliminating the spacer frame 42 and surrounding bonding material 44.

While the forms of window assembly and the methods of assembly herein described constitute preferred embodiments of the invention, it is to be understood that the invention is not limited to the precise methods and forms of assembly described, and that changes may be made therein without departing from the scope and spirit of the invention as defined in the appended claims.

What is claimed is:

1. A window assembly comprising a rectangular outer sash frame including a set of elongated sash frame members of extruded rigid plastics material with said sash frame members rigidly connected at corner portions of said sash frame, a set of parallel spaced rectangular inner and outer glass panels surrounded by said outer sash frame, said sash frame members including flange portions projecting laterally inwardly and overlapping a peripheral edge portion of said outer glass panel, said flange portions having integral flexible lip seals engaging said outer glass panel, a rectangular inner sub-sash frame disposed within said outer sash frame and including elongated sub-sash frame members of extruded rigid plastics material, said sub-sash frame members rigidly connected at corner portions of said sub-sash frame and including laterally inwardly projecting flange portions overlapping a peripheral edge portion of said outer glass panel, a bonding material securing said flange portions of said sub-sash frame members to said peripheral edge portion of said outer glass panel, said flange portions of said sash frame members having inwardly projecting longitudinally extending ribs, said sub-sash frame members have base portions with longitudinally extending slots receiving said ribs to limit lateral movement of said sub-sash frame within said outer sash frame, a set of elongated glazing members of extruded plastics material, said glazing members including laterally inwardly projecting flange portions overlapping a peripheral edge portion of said inner glass panel, and said glazing members including retaining portions releasably engaging said outer sash frame and spring-like flange portions releasably engaging said base portions of said sub-sash frame members.

2. A window assembly as defined in claim 1 wherein said sub-sash frame members are mitered and welded at said corner portions of said sub-sash frame.

3. A window assembly as defined in claim 1 wherein said base portion of each said sub-sash frame member has inwardly and outwardly facing grooves and a generally H-shape cross-sectional configuration, and said base portions cover outer edge surfaces of said glass panels.

4. A window assembly comprising a rectangular outer sash frame including a set of elongated sash frame members of extruded rigid plastics material with said sash frame members rigidly connected at corner portions of said sash frame, a set of parallel spaced rectangular inner and outer glass panels surrounded by said outer sash frame, said sash frame members including flange portions projecting laterally inwardly and overlapping a peripheral edge portion of said outer glass panel, a rectangular inner sub-sash frame disposed within said outer sash frame and including elongated sub-sash frame members of extruded rigid plastics material, said sub-sash frame members including laterally inwardly projecting flange portions overlapping a peripheral edge portion of at least one of said glass panels, a bonding material securing said flange portions of said sub-sash frame members to said peripheral edge portion of said one glass panel, a set of elongated glazing members of extruded plastics material, said glazing members including laterally inwardly projecting flange portions overlapping a peripheral edge portion of said inner glass panel, said glazing members including retaining portions engaging said outer sash frame, each of said sash frame members including an inner wall defining a recess, and said retaining portion of the corresponding said glazing member comprises a spring-like flange portion seated within said recess and pressing against the corresponding said sub-sash frame member.

5. A window assembly comprising a rectangular outer sash frame including a set of elongated sash frame members of extruded rigid plastics material with said sash frame members rigidly connected at corner portions of said sash frame, a set of parallel spaced rectangular inner and outer glass panels surrounded by said outer sash frame, said sash frame members including flange portions projecting laterally inwardly and overlapping a peripheral edge portion of said outer glass panel, said flange portions having integral flexible lip seals engaging said outer glass panel, a rectangular inner sub-sash frame disposed within said outer sash frame and including elongated sub-sash frame members of extruded rigid plastics material, said sub-sash frame members including laterally inwardly projecting flange portions overlapping a peripheral edge portion of at least one of said glass panels, a bonding material securing said flange portions of said sub-sash frame members to said peripheral edge portion of said one glass panel, a set of elongated glazing members of extruded plastics material, said glazing members including laterally inwardly projecting flange portions overlapping a peripheral edge portion of said inner glass panel, said glazing members including retaining portions releasably engaging said outer sash frame and spring-like flange portions releasably engaging said sub-sash frame, and said sash frame members and said sub-sash frame members have longitudinally extending interfitting portions limiting lateral movement of said sub-sash frame within said outer sash frame.

6. A window assembly as defined in claim 5 wherein said sub-sash frame members are mitered and welded at said corner portions of said sub-sash frame.

7. A window assembly as defined in claim 5 wherein each of said sub-sash frame members includes a base portion integrally connected to a corresponding said flange portion, and said base portion has generally an H-shape cross-sectional configuration and covers outer edge surfaces of said glass panels.

8. A window assembly as defined in claim 5 wherein each of said sash frame members includes an inner wall defining a recess, and said retaining flange portion of the corresponding said glazing member seats within said recess and presses laterally inwardly against the corresponding said sub-sash frame member.

9. A window assembly comprising a rectangular outer sash frame including a set of elongated extrusions of rigid plastics material forming outer sash frame members having mitered and welded corner portions for said sash frame, a set of parallel spaced rectangular inner and outer glass panels surrounded by said outer sash frame and having peripheral edge portions bonded together, said sash frame members of said outer sash frame including integral flange portions projecting laterally inwardly and overlapping a peripheral edge portion of said outer glass panel, said flange portions of said outer sash frame members including lip seals contacting said outer glass panel, a rectangular inner sub-sash frame disposed within said outer sash frame and including elongated extrusions of rigid plastic material forming sub-sash frame members having mitered and welded corner portions for said sub-sash frame, said sub-sash frame members including longitudinally extending and laterally inwardly projecting integral flange portions overlapping a peripheral edge portion of only said outer glass panel, said flange portions of said frame members of said outer sash frame overlapping said flange portions of said sub-sash frame members of said inner sub-sash frame around the entire peripheral edge portion of said outer glass panel, a bonding material securing said flange portions of said sub-sash frame members to said peripheral edge portion of said outer glass panel, a set of elongated extrusions of plastics material forming removable glazing members, said glazing members including laterally inwardly projecting flange portions overlapping a peripheral edge portion of said inner glass panel and including lip seals contacting said inner glass panel, said sub-sash frame members including longitudinally extending integral base portions closely surrounding and overlapping peripheral edge surfaces of said glass panels, and said glazing members including retaining portions engaging said frame members of said outer sash frame and also engaging said base portions of said sub-sash frame members.

10. A window assembly as defined in claim 9 wherein said base portions of said sub-sash frame members define longitudinally extending grooves perpendicular to said glass panels, and said flange portions of said outer sash frame members include longitudinally extending ribs projecting into said grooves to facilitate assembly of said sub-sash frame into said outer sash frame and to limit lateral movement of said sub-sash frame within said outer sash frame.

11. A window assembly comprising a rectangular outer sash frame including a set of elongated extrusions of rigid plastics material forming outer sash frame members having mitered and welded corner portions for said outer sash frame, a set of parallel spaced rectangular inner and outer glass panels surrounded by said outer sash frame, said sash frame members of said outer sash frame including longitudinally extending integral flange portions projecting laterally inwardly and overlapping a peripheral edge portion of said outer glass panel, said flange portions of said outer sash frame members including lip seals contacting said outer glass panel, a rectangular inner sub-sash frame disposed within said outer sash frame and including elongated extrusions of rigid plastics material forming sub-sash frame members having mitered and welded corner portions for said sub-sash frame, said sub-sash frame members including longitudinally extending base portions integrally connecting parallel spaced longitudinally extending wall portions projecting laterally inwardly between said peripheral edge portions of said glass panels and bonded to said edge portions of both said glass panels, said base portions of said sub-sash frame members overlapping outer peripheral edge surfaces of said glass panels, a set of elongated extrusions of plastics material forming removable glazing members including laterally inwardly projecting flange portions overlapping and sealed to a peripheral edge portion of said inner glass panel, and said glazing members including retaining portions engaging said sash frame members of said outer sash frame and also engaging said base portions of said sub-sash frame members.

12. A window assembly as defined in claim 11 wherein said base portions of said sub-sash frame members define longitudinally extending grooves perpendicular to said glass panels, and said flange portions of said outer sash frame member include longitudinally extending ribs projecting into said grooves to facilitate assembly of said sub-sash frame into said outer sash frame and to limit lateral movement of said sub-sash frame within said outer sash frame.

* * * * *